US009938858B2

(12) United States Patent
Klingels

(10) Patent No.: US 9,938,858 B2
(45) Date of Patent: Apr. 10, 2018

(54) MID-FRAME FOR A GAS TURBINE AND GAS TURBINE HAVING SUCH A MID-FRAME

(71) Applicant: MTU Aero Engines AG, Munich (DE)

(72) Inventor: Hermann Klingels, Dachau (DE)

(73) Assignee: MTU AERO ENGINES AG, Munich (DE)

( * ) Notice: Subject to any disclaimer, the term of this patent is extended or adjusted under 35 U.S.C. 154(b) by 244 days.

(21) Appl. No.: 14/732,284

(22) Filed: Jun. 5, 2015

(65) Prior Publication Data

US 2015/0361893 A1 Dec. 17, 2015

(30) Foreign Application Priority Data

Jun. 12, 2014 (EP) ..... 14172048

(51) Int. Cl.

| | |
|---|---|
| ***F01D 25/16*** | (2006.01) |
| ***F01D 25/26*** | (2006.01) |
| ***F01D 25/24*** | (2006.01) |
| *F01D 9/06* | (2006.01) |
| *F01D 9/04* | (2006.01) |

(Continued)

(52) U.S. Cl.

CPC ..... *F01D 25/26* (2013.01); *F01D 25/162* (2013.01); *F01D 25/246* (2013.01); *F01D 9/041* (2013.01); *F01D 9/06* (2013.01); *F01D 9/065* (2013.01); *F01D 25/12* (2013.01); *F01D 25/164* (2013.01); *F01D 25/28* (2013.01); *F05D 2230/642* (2013.01); *F05D 2260/36* (2013.01)

(58) Field of Classification Search

CPC ..... F01D 25/162; F01D 25/26; F01D 25/246; F01D 9/06; F01D 9/065; F01D 25/28; F01D 25/12; F01D 9/041; F01D 25/164

USPC ..... 415/142

See application file for complete search history.

(56) References Cited

U.S. PATENT DOCUMENTS

| | | | | |
|---|---|---|---|---|
| 6,763,653 | B2 | 7/2004 | Orlando et al. | |
| 2008/0031727 | A1* | 2/2008 | Sjoqvist | F01D 25/162 415/142 |
| 2010/0303610 | A1 | 12/2010 | Wang et al. | |

(Continued)

FOREIGN PATENT DOCUMENTS

| | | | |
|---|---|---|---|
| EP | 1548231 | A2 | 6/2005 |
| EP | 2400119 | A2 | 12/2011 |

(Continued)

*Primary Examiner* — Woody Lee, Jr.
*Assistant Examiner* — Behnoush Haghighian
(74) *Attorney, Agent, or Firm* — Barlow, Josephs & Holmes, Ltd.

(57) ABSTRACT

The invention relates to a mid-frame (10) for a gas turbine, having at least one outer casing element (24), having at least one hub element (26) arranged on the inside of the outer casing element (24) in the radial direction, having a least one strut (42) by means of which the outer casing element (24) is connected to the hub element (26), and having at least one fairing element (46) that delimits at least partially a duct (44) at least in the radial direction, through which a gas can flow, and is constructed separately from the casing element (46), said fairing element having a passage opening (48), through which the strut (42) passes, for at least partial cladding of the strut on the outer peripheral side, wherein the fairing element (46) is coupled exclusively to the hub element (26), at least in the radial direction.

11 Claims, 3 Drawing Sheets

Figure 1:
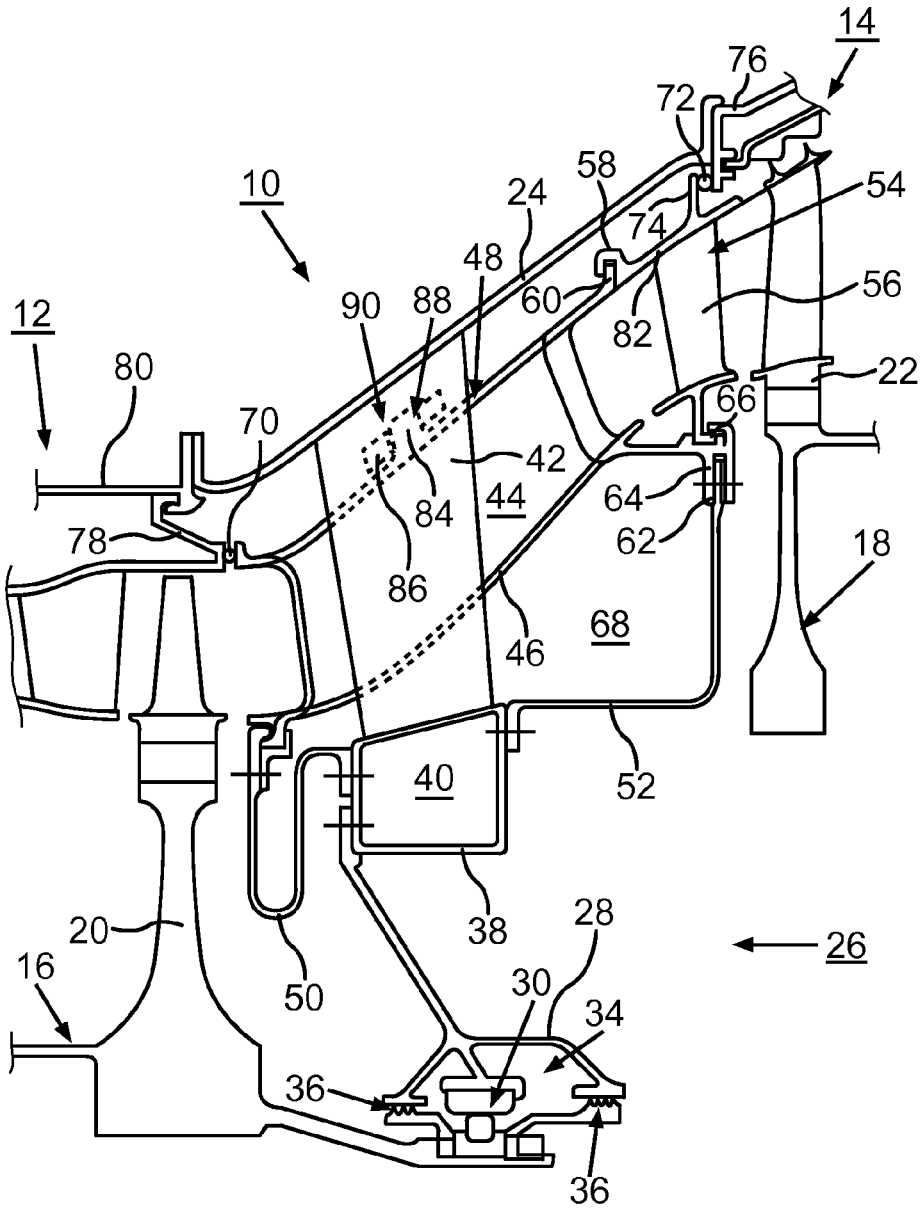

(51) Int. Cl.
*F01D 25/12* (2006.01)
*F01D 25/28* (2006.01)

(56) References Cited

U.S. PATENT DOCUMENTS

2012/0321447 A1* 12/2012 Dijoud ..... F01D 9/041
415/142
2015/0260057 A1* 9/2015 Farah ..... F01D 25/24
60/796

FOREIGN PATENT DOCUMENTS

FR 2956695 A1 8/2011
WO 2014052007 A1 4/2014

* cited by examiner

MID-FRAME FOR A GAS TURBINE AND GAS TURBINE HAVING SUCH A MID-FRAME

BACKGROUND OF THE INVENTION

The invention relates to a mid-frame according to the preamble of patent claim 1 and a gas turbine having such a mid-frame.

A mid-frame for a gas turbine is to be taken as known from U.S. Pat. No. 6,763,653 B2, for example. The mid-frame comprises at least one outer casing element, in particular in the form of an outer casing shell, which is designed to be at least essentially ring-shaped, for example. The mid-frame further comprises at least one hub element arranged on the inside of the outer casing element in the radial direction. The hub element is at least essentially a ring-shaped inner structure, for example, which forms or delimits at least partially a hub or a hub chamber or a bearing chamber of the gas turbine. For example, at least one rotor, in particular at least one turbine wheel, of the gas turbine is mounted on the hub element so as to rotate around an axis of rotation relative to the hub element. Here, the rotor, for example, is arranged at least partially in the hub element or in the hub.

The mid-frame further comprises at least one strut, which extends at least essentially in the radial direction, for example. The outer casing element is connected to the inner hub element via the strut. A plurality of such struts, by means of which the outer casing element is connected to the hub element, is usually provided.

Moreover, the mid-frame comprises at least one cladding element, which is usually referred to as a "fairing." The strut is at least partially clad on the outer peripheral end by means of the fairing element. For this purpose, the fairing element has a passage opening through which the strut passes. In other words, the strut extends through the passage opening in the radial direction.

Moreover, a duct through which a gas can flow is delimited at least partially by the fairing element at least in the radial direction. The gas is a hot gas, for example, so that the duct is also referred to as a "hot-gas duct." The strut is protected from the hot gas by means of the fairing element, because the hot gas (gas) is conducted around the strut by means of the fairing element and thus cannot flow directly against the strut.

Such a mid-frame is generally employed for multiple-shaft gas turbines. In such a multiple-shaft gas turbine, the duct, constructed as a flow duct that conducts hot gas, is usually arranged between the turbine regions of the gas turbine in the direction of flow of the gas. In a two-shaft gas turbine, a first of the turbine regions is a high-pressure turbine region, for example, while the second turbine region is a low-pressure turbine region. In a three-shaft gas turbine, the flow duct that conducts the hot gas is arranged, for example, between the high-pressure turbine region and an intermediate-pressure turbine region of the three-shaft gas turbine. Alternatively or additionally, such a flow duct that conducts a hot gas is arranged between the intermediate-pressure turbine region and the low-pressure turbine region of the three-shaft gas turbine.

The strut, arranged in the region of the duct, ensures a structural connection of the outer casing element to the hub element and crosses the gas flow. In small gas turbines, the duct is often designed as an integral component. In larger gas turbines, however, a segmented construction design of the duct is provided. In such a segmented construction design, usually a plurality of duct segments, such as, for example, the fairing element, are provided, which are arranged in the peripheral direction of the outer casing element in succession, that is, one behind the other. At least one duct for conducting the gas is delimited at least partially by the respective duct segments.

US 2010/0303610 A1 discloses a mid-frame for a gas turbine, having at least one outer casing element, having at least one hub element arranged on the inside of the outer casing element in the radial direction, having at least one strut, by means of which the outer casing element is connected to the hub element, and having at least one fairing element that delimits at least partially a duct, through which a gas can flow, at least in the radial direction and is constructed separately from the casing element, said fairing element having a passage opening, through which the strut passes, for at least partial cladding of the strut on the outer peripheral side.

SUMMARY OF THE INVENTION

The object of the present invention is to create a mid-frame as well as gas turbine of the kind mentioned in the introduction, in which an excessive input of heat into the outer casing element can be prevented, while, at the same time, a weight-favorable and cost-effective construction of the mid-frame is realized.

This object is achieved by a mid-frame having the features of a gas turbine having the features of the present invention. Advantageous embodiments with appropriate enhancements of the invention are presented in the respective dependent claims, in which advantageous embodiments of the mid-frame are to be regarded as advantageous embodiments of the gas turbine and vice versa.

A first aspect of the invention relates to a mid-frame for a gas turbine, which has at least one outer casing element. The mid-frame further has at least one hub element arranged on the inside of the outer casing element in the radial direction. Moreover, the mid-frame comprises at least one strut, by means of which the outer casing element is connected to the hub element. In addition, the mid-frame comprises at least one fairing element that is constructed separately from the casing element and by means of which a duct, through which a gas can flow, is at least partially delimited in at least the radial direction. The fairing element thus functions as a duct segment. Moreover, the fairing element serves for at least partial cladding of the strut on the outer peripheral side. For this purpose, the fairing element has a passage opening, through which the strut passes. As a result, the strut is clad at least partially on the outer peripheral side by means of the fairing element.

Now, in order to prevent an excessive input of heat into the outer casing element during operation of the gas turbine, while, at the same time, realizing a weight-favorable and cost-effective design of the mid-frame, it is provided according to the invention that the fairing element is coupled exclusively to the hub element, at least in the radial direction. This is to be understood to mean that there is no radial coupling between the fairing element and the outer casing element, which represents an outer casing shell, for example. This coupling of the fairing element, functioning as a duct segment, enables the creation of a segmented construction design of the duct, while, at the same time, preventing an excessive input of heat into the casing element, said duct being delimited at least partially by the fairing element. In the segmented construction design, for example, a plurality of fairing elements, constructed separately from the casing element, are provided, said fairing elements being arranged in succession in the peripheral direction of the casing element and each of them delimiting at least partially in the radial direction at least one duct through which a gas can flow. The prevention of an excessive input of heat also results in an especially long service life of the mid-frame, because loads acting on the outer casing element can be minimized.

In an especially advantageous embodiment of the invention, the fairing element is coupled to the hub element in the radial direction by means of at least one support element. In doing so, in order to keep the input of heat into the casing element especially low and to realize an especially efficient operation of the gas turbine, preferably at least one guide vane is provided for at least partial guiding of the gas flowing through the duct, said guide vane being supported by the support element in the radial direction.

The guide vane serves for diverting or redirecting the gas flowing through the duct, so that it is possible to impose an advantageous flow or direction of flow on the gas. For example, it is then possible for the gas to flow through the gas duct in an aerodynamically especially advantageous way. Alternatively or additionally, it is possible to guide the gas or the flow thereof by means of the guide vane in such a way that the gas can flow against a turbine wheel, which is arranged downstream of the guide vane in the direction of the flow of gas through the duct in an especially advantageous manner. As a result, it is possible to favor the efficiency of operation of the gas turbine and thus realize an especially efficient operation thereof.

Moreover, by supporting the guide vane in the radial direction inward on the support element, an excessive input of heat from the guide vane into the outer casing element can be prevented, because, for example, it is possible to dispense with a direct attachment of the guide vane to the outer casing element. In particular, the guide vane is held on the support element at least in the radial direction and is held on the inner hub element via the support element. A direct contact of the guide vane with the outer casing element and an excessive heating of the outer casing element resulting from this during operation of the gas turbine can thus be prevented.

The support element serves a dual function here. On the one hand, the support element serves for fastening or holding the fairing element on the hub element. Moreover, the support element serves, on the other hand, to support the guide vane in the radial direction, in particular inward. In this case, it is preferably provided that a direct contact between the fairing element and/or the guide vane and the outer casing element is prevented. In other words, it is preferably provided that the fairing element is completely spaced apart from the outer casing element at least in the radial direction and/or is not fastened to the outer casing element. Because neither the fairing element, functioning as a duct segment, nor the guide vane is thus in direct contact with the outer casing element, the heating of the outer casing element, that is, the input of heat into the outer casing element, can be kept especially small. As a result, any material from which the outer casing element is constructed is subjected less strongly to thermal load than in the prior art, so that a lower-cost material can be used for producing the outer casing element. As a result, the costs of the mid-frame and the gas turbine can be minimized overall.

As a result of the fastening of the fairing element to the support element and owing to the supporting of the guide vane on the support element, it is possible to dispense with fastening elements, such as, for example, hangers for fastening the fairing element and the guide vane to the outer casing element, so that the number of parts, the weight, and the costs of the mid-frame can be kept especially small. These fastening elements, which can be dispensed with, are, for example, generally provided passage openings, such as, for example, bored holes in the outer casing element, or screws, nuts, and small parts. It is also possible to dispense with the generally provided thicker material in the region of the generally provided bored holes. As a result, it is possible to keep the weight and the fabrication expense for producing the mid-frame, in particular the outer casing element, especially small.

Another advantage is that the radial position of the fairing element and guide vane is usually determined by the outer casing element, which, during operation of the gas turbine, has a lower temperature that does the fairing element and the guide vane itself, because, during operation of the gas turbine, the guide vane and the fairing element come into direct contact with the hot gas. In the mid-frame according to the invention, however, the radial position or location of the fairing element and guide vane are determined primarily by the expansion behavior of the support element. Because the temperature of said support element is the same as or similar to that of the fairing element and the guide vane in the region of contact with the fairing element and the guide vane, it is possible—when a plurality of fairing elements and guide vanes are provided—to keep any thermally induced movement of the fairing elements and guide vanes toward each other especially small, particularly in the peripheral direction.

If, for example—in particular, in the case of a segmented construction design of the duct—a plurality of fairing elements and/or a plurality of guide vanes is provided, the guide vanes being arranged in succession in the peripheral direction, any thermally induced movements of the guide vanes or fairing elements relative to one another can be kept especially small. The transient radial expansion behavior of the fairing elements and the guide vanes is also better adapted to the surroundings than in the case of conventional mid-frames. All in all, in the mid-frame according to the invention, substantially smaller displacements at the respective points allowing such displacements, in particular sliding points, are to be expected. As a result, the wear of the mid-frame can be kept especially small. Moreover, it is possible to achieve an especially good sealing effect, so that undesired leakage flows can be kept at least small. This contributes overall to the efficient operation of the gas turbine.

It has been found to be especially advantageous when the support element is constructed separately from the hub element and separately from the fairing element and, in particular, separately from the guide vane.

In an especially advantageous embodiment of the invention, the guide vane is fastened to the fairing element. In this way, it is possible to keep the effort for fastening and holding the guide vane especially small. Moreover, it is possible to realize an especially advantageous flow of the gas from the fairing element to the guide vane or vice versa.

It has been found to be especially advantageous when the guide vane is fastened to the fairing element in a form-fitting manner, in particular in the axial direction. As a result, it is possible to fix the guide vane in place in an especially simple and, at the same time, effective manner. In addition, it is possible to realize an especially simple assembly of the mid-frame. Preferably, the fairing element, the guide vane, the inner hub element, and the outer casing element are constructed as component parts that are produced separately from one another.

Another embodiment is characterized in that the fairing element and the strut each have form-fitting elements, by means of which the fairing element can be supported on or is supported on the strut in the axial direction in a form-fitting manner. This embodiment is based on the realization that the gas flowing through the duct experiences a change in pressure due to the duct and the guide vane. This results in compressive forces that act particularly in the axial direction. These compressive forces are preferably guided into the outer casing element. The form-fitting elements enable the compressive forces to be directed especially advantageously and via a very small path into the outer casing element, while, at the same time, preventing an excessive input of heat into the outer casing element. In particular, the compressive forces can be guided nearly directly into the outer casing element by means of only a very small lever arm.

In another advantageous embodiment of the invention, it is provided that the form-fitting elements are arranged in the radial direction closer to the outer casing element than to the hub element. In particular, it can be provided that the form-fitting elements are arranged on a side of the fairing element that faces away from the hub element outward in the radial direction. In this way, the path, in particular the lever arm, by means of which the forces can be directed into the outer casing element can be kept especially small.

In another embodiment of the invention, it is provided that the guide vane has an outer shroud in the radial direction, whereby a chamber that surrounds the duct at least partially is delimited at least partially by the outer shroud and the fairing element. This chamber can be supplied with gas, in particular with sealing air. The sealing air has a lower temperature. In particular, the sealing air has a lower temperature in comparison to the gas flow through the duct. Furthermore, the sealing air has a higher pressure in comparison to the gas flowing through the duct. As a result, it is possible to prevent gas from coming into contact with structural parts and supply lines, in particular those for the hub element, owing to leakage from the duct. The sealing air thus serves particularly for preventing any penetration or incursion of hot gas from the duct into the chamber.

Finally, it has been demonstrated to be advantageous when the chamber is sealed with respect to the duct by at least one sealing element, which is supported at least on a support flange of the outer shroud. In this way, an excessive incursion of hot gas into the chamber can be prevented effectively.

A second aspect of the invention relates to a gas turbine having at least one mid-frame according to the invention. Here, it is provided that the duct is arranged between two turbine regions of the gas turbine in the direction of flow of the gas.

BRIEF DESCRIPTION OF THE DRAWING FIGURES

Further advantages, features, and details of the invention ensue from the following description of a preferred exemplary embodiment as well as on the basis of the drawing. The features and combinations of features mentioned above in the description as well as the features and combinations of features shown in the sole figure alone can be used not only in the respectively presented combination, but also in other combinations or by themselves, without departing from the scope of the invention.

Figure 2:
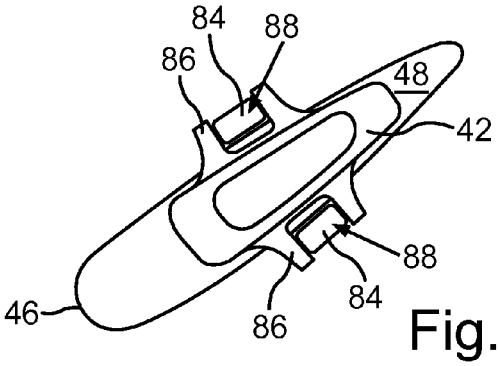
Figure 3:
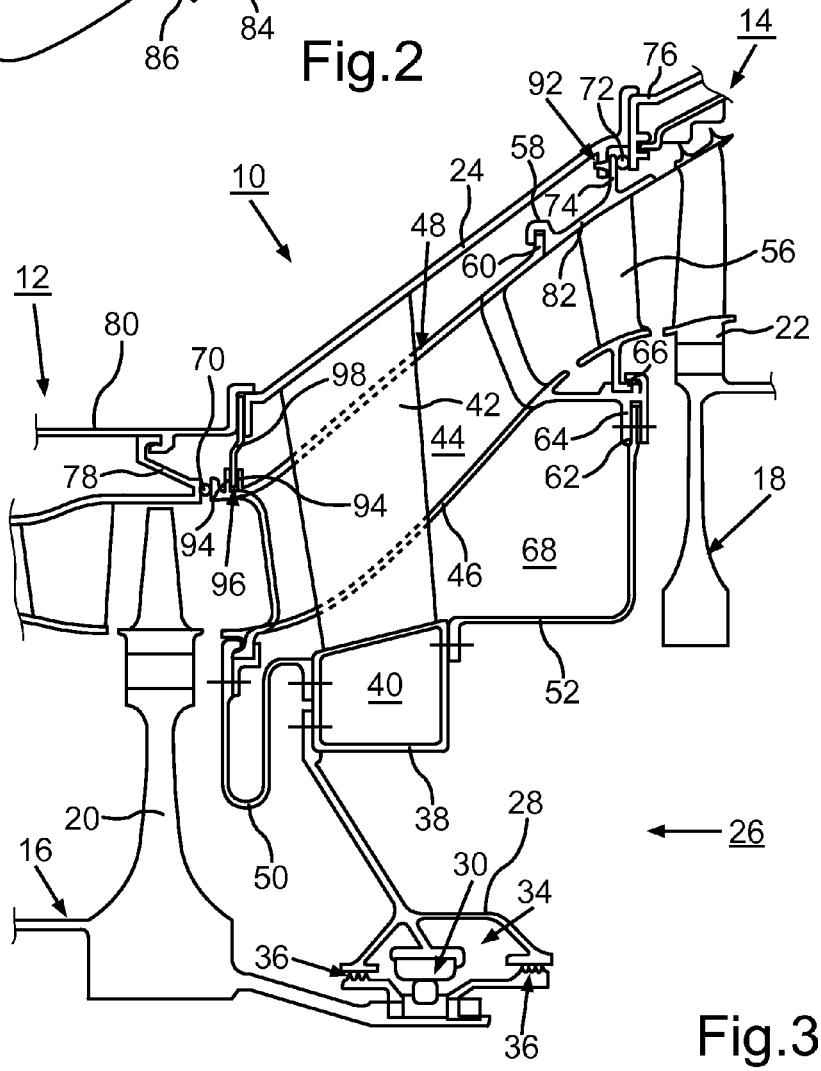
Figure 4:
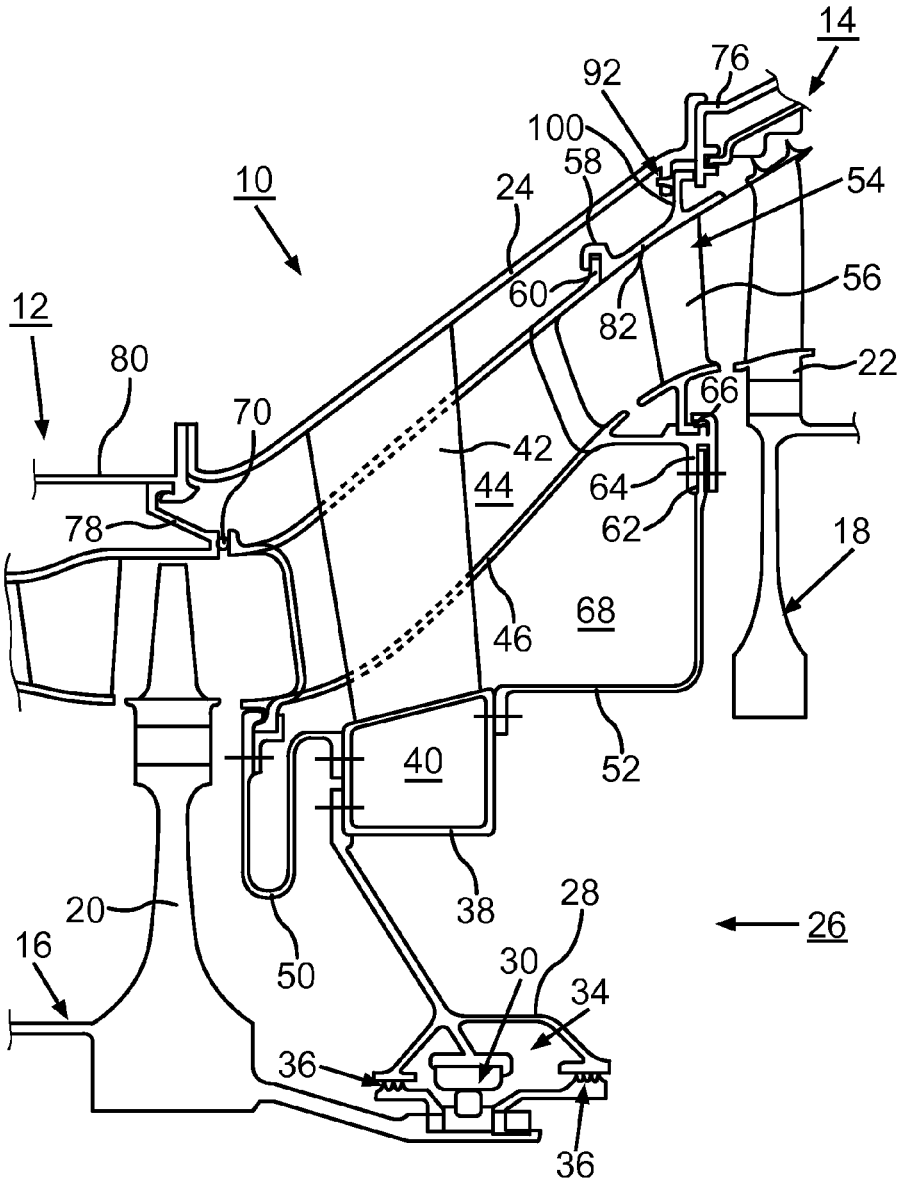

Shown in the drawing are:

FIG. 1 a schematic cutout sectional view of a gas turbine according to a first embodiment, having a mid-frame, in which at least one fairing element that at least partially delimits a duct is coupled exclusively to a hub element at least in the radial direction and thus is not coupled to an outer casing element of the mid-frame;

FIG. 2 a schematic cross-sectional view of a strut, by means of which the hub element is connected to the outer casing element of the mid-frame;

FIG. 3 a schematic cutout sectional view of the gas turbine according to a second embodiment; and FIG. 4 a schematic cutout sectional view of the gas turbine according to a third embodiment.

In the figures, identical or functionally identical elements are provided with the same reference numbers.

DESCRIPTION OF THE INVENTION

FIG. 1 shows, in a schematic longitudinal view, a gas turbine according to a first embodiment, having has a mid-frame 10, a first turbine region 12 arranged in the axial direction in front of the mid-frame 10, and a second turbine region 14 arranged in the axial direction behind the mid-frame 10. The turbine regions 12, 14 are, for example, turbine stages of the gas turbine. These turbine stages each comprise rotors 16, 18 with respective turbine wheels 20, 22.

The mid-frame 10 has an outer casing element 24, which, for example, is designed at least essentially as a ring-shaped casing shell. Moreover, the mid-frame 10 comprises a hub element, identified overall by 26, which, for example, is designed as an at least essentially ring-shaped inner structure. The hub element 26 is arranged on the inside of the outer casing element 24 in the radial direction of the gas turbine and thus of the mid-frame 10.

The hub element 26 comprises, for example, a first hub part 28, on which the rotor 16 is rotatably mounted around an axis of rotation relative to the hub element 26 and relative to the mid-frame 10. For this purpose, a bearing 30 is provided, which is designed as a roller bearing, for example. The rotor 16 is supported on the hub element 26 in the radial direction outward by means of the bearing 30 and mounted on it. The bearing 30 is arranged in a receiving space 34, which is sealed by means of seals 36, for example. For example, a bearing chamber is delimited at least partially by the hub part 28. The rotor 16 is at least partially accommodated in this bearing chamber, for example. It is also conceivable for the rotor 18 to be accommodated at least partially in the bearing chamber.

Moreover, the hub element 26 comprises a second hub part 38, which is designed in the present case as a profile component and has a closed hollow cross section 40. The second hub part 38 is also referred to as a "hub" or "hub body." In the embodiment shown in FIG. 1, the hub (second hub part 38) is designed at least essentially ring-shaped or as a torsionally rigid, box-shaped ring, to which the bearing chamber formed by the hub part 28 is fastened. In other words, the hub parts 28, 38 are designed as components that are produced separately from each other and connected to each other. In an alternative embodiment, the hub element 26 can be formed by a single ring or it can be formed by two axially distanced rings. In another embodiment, the hub part 38 can be dispensed with. The hub part could have an open cross section, in particular a hollow cross section, instead of the closed hollow cross section 40. The casing element 24 and the hub element 26 are arranged concentrically with respect to the axis of rotation, which is referred to as the "engine axis."

The mid-frame 10 comprises preferably a plurality of struts, one of which, a strut identified by 42, can be seen in FIG. 1. The following statements in regard to the strut 42 can be transferred also to the other struts in a straightforward manner. The struts are arranged distributed in the peripheral direction of the hub element 26 around the circumference thereof, in particular with uniform distribution, with the outer casing shell (outer casing element 24) being connected to the hub element 26 by means of the struts.

As can be seen in FIG. 1 on the basis of strut 42, the strut 42 is joined at one end to the outer casing element 24 and at the other end to the hub part 38. The hub part 38 is employed in particular in the case when a duct 44 of the mid-frame 10, formed as a hot-gas duct, is arranged in the radial direction far removed from the axis of rotation. In the present case, the strut 42 is connected via the hub part 38 to the hub part 28 and thus to the hub element 26. If the hub part 38 is provided, for example, then the strut 42, designed as a rib, is connected directly to the bearing chamber, that is, the hub part 28.

Moreover, the mid-frame 10 comprises a fairing element 46, which is also referred to as a "fairing" and is designed as a duct segment. Namely, the duct 44 is at least partially delimited at least in the radial direction by the fairing element 46. In the present case, the duct 44 is delimited at least partially in the radial direction outward and in the radial direction inward by the fairing element 46.

For example, a plurality of fairing elements are provided, with the duct 44 and/or the respective ducts of the mid-frame 10 through which gas can flow being delimited at least partially at least in the radial direction by the respective fairing elements. The following statements regarding the fairing elements 46 can be transferred also to the other fairing elements that cannot be seen in FIG. 1 in a straightforward manner. For example, it is provided that a segmented construction design of the duct 44 or of the ducts is provided. The individual duct segments are arranged in succession in the peripheral direction of the casing element 24, for example, that is, arranged one behind the other.

The fairing element 46 is a component that is produced separately from the casing element 24 and from the hub element 26 and also serves at least partially for cladding of the strut 42 on the outer peripheral side. To this end, the fairing element 46 has a passage opening 48, through which the strut 42 passes. The strut 42 extends at least essentially in the radial direction from the casing element 24 to the hub part 38 and then through the passage opening 48, so that the strut 42 is surrounded on the outer peripheral side at least partially by the fairing element 46. In the present case, the strut 42 is completely surrounded, in relation to its radial extension, at least in its longitudinal region and in its peripheral direction in this longitudinal region, by the fairing element 46. Thus, by means of the fairing element 46, the gas flowing through the duct 44 is directed around the strut 42 without directly contacting the strut 42. As a result, the strut is protected from direct contact with the hot gas. The turbine region 12 is arranged upstream of the duct 44 in the direction of flow of gas through the duct 44, while the turbine region 14 is arranged downstream of the duct 44.

FIG. 2 shows the strut 42 and the fairing element 46 in a schematic cross-sectional view. It can be seen from FIG. 2 that the fairing (fairing element 46) is designed as a hollow aerodynamic profile having an outer and an inner subcomponent. In addition to such fairings, the duct 44 or the ducts can be delimited by so-called panels. Such panels are at least essentially flat structural components, which, for example, delimit the remaining annular space between the fairings. Depending on the dimensions of the duct 44 and the number of struts used, different constructions are conceivable. For example, the duct 44 can be delimited or formed by fairings and panels that are respectively on the inside and on the outside, or by fairing and panels that are respectively on the outside, or solely by fairings.

It can be seen in FIG. 1 that the fairing element 46 is coupled exclusively to the hub element 26 at least in the radial direction. This means that the fairing element 26 is not coupled to or fastened to the casing element 24, but rather the fairing element 46 is supported in the radial direction exclusively at the hub element 26 and, in the present case, on the hub part 38 via support elements 50, 52. To this end, the fairing element 46 is fastened to the support elements 50, 52, which, in turn, are fastened to the hub part 38. In this case, the support elements 50, 52 are relatively pliable in the axial direction in comparison to the radial direction. For this purpose, the support elements 50, 52 are designed like membranes or in the shape of membranes. In other words, the support elements 50, 52 are formed as membranes by means of which the fairing element 46 is supported on the hub element 26 in the radial direction. In the mentioned embodiment, in which the struts are directly connected to the bearing chamber, the support elements 50, 52 can be fastened directly to the bearing chamber, that is, to the hub part 28, and/or directly to the strut 42. During operation of the gas turbine, different thermal expansions between the fairing elements, functioning as duct segments, and the inner structure in the form of the hub element 26, which is cooler, can be compensated for by the axial flexibility of the support elements 50, 52. The support elements absorb radial forces and serve for fixing the fairing element 46 in place peripherally.

Moreover, the mid-frame 10 comprises at least one guide vane element 54, which is also referred to as a "guide vane segment." The guide vane element 54 comprises at least one guide vane 56 for at least partial guiding of the gas flowing through the duct 44. In this case, the mid-frame 10 has a plurality of guide vane segments, one of which, the guide vane element 54, can be seen in FIG. 1. The following statements regarding the guide vane element 54 can also be transferred to the other guide vanes in a straightforward manner. The guide vanes create a guide grid for guiding the gas. Therefore, the guide vanes are also referred to as "guide grid segments."

It can be seen in FIG. 1 that the guide vane 56 is arranged in the direction of flow of the gas through the duct 44 downstream of the fairing element 46 and upstream of the turbine region 14.

The guide vane 56 serves to redirect or divert at least a part of the gas flowing through the duct 44 in such a way that the gas can flow in an aerodynamically advantageous manner against a blade assembly of the rotor 18. As a result, it is possible to realize an especially efficient operation of the gas turbine.

It is provided in the mid-frame 10 that the guide vane 56 is not held on the outer casing element 24, for instance, but rather the guide vane 56 is supported on the support element 52 in the radial direction. As a result, the guide vane 56 is supported, and in particular retained, in the radial direction inward on the hub element 26 by means of the support element 52.

Moreover, it is provided that the guide vane 56 is connected in a form-fitting manner to the corresponding fairing element 46. In other words, the guide vane 56 is fastened in a form-fitting manner to the corresponding fairing element 46 in the axial direction. Thus, the guide vane 56 is supported on the fairing element 46 in the axial direction. For this purpose, the guide vane 56 comprises a receiving element 58, by means of which an uptake space is delimited. A flange 60 of the fairing element 46 is accommodated at least partially in the uptake space, with the flange 60 being covered at least partially by the receiving element 58 in the axial direction. This results in the form-fitting fastening of the guide vane 56 to the fairing element 46 in the axial direction.

The support element 52 has a flange 62, which is accommodated in an uptake space of a corresponding receiving element 64 of the fairing element 46, at least in some regions. The fairing element 46 is fastened in the radial direction to the support element 52 by means of the receiving element 64 and the flange 62, and by means of said support element to the hub element 26.

The receiving element 64 has another uptake space, in which a flange 66 of the guide vane 56 is accommodated at least partially. Thus, the guide vane 56 is supported on the support element 52 at least in the radial direction by means of the receiving element 64.

The guide vane 56 has an outer shroud in the radial direction, which is referred to as an "outer shroud 82." A chamber 68 is delimited at least partially by the support elements 50, 52, the fairing element 46, and the outer shroud 82, said chamber surrounding the duct 44 at least partially on the outside. The chamber 68 is supplied with sealing air, which has a higher pressure and a lower temperature in comparison to the gas flowing through the duct 44. By means of the sealing air, it can be ensured that structural parts and supply lines, in particular the bearing chamber, do not come into contact with hot gas flowing through the duct 44. In particular, the sealing air can prevent hot gas from flowing from the duct 44 through a gap into the chamber 68.

The chamber 68 is sealed with respect to the duct 44 by means of sealing elements 70, 72, which are illustrated especially schematically in the present case and can be designed as leaf seals or brush seals, for example. In this case, the sealing element 72 is supported, on the one hand, on the guide vane 56, in particular on a support flange 74, of the outer shroud 82, and, on the other hand, on a casing element 76 of the turbine region 14. The support flange 74 thus acts as a sealing flange. The sealing element 70 is supported, on the one hand, on the fairing element 46 and, on the other hand, via a supporting element 78 on a casing element 80 of the turbine region 12. This means that the sealing elements 70, 72, in combination with the support elements 50, 52, form the chamber 68, in particular around the fairing element 46, with the sealing elements 70, 72 enclosing the guide vane 56.

The gas flowing through the duct 44 undergoes a change in pressure due to the duct 44 and the guide grid. As a result, the pressure of the gas upstream of the turbine region 14 is lower than downstream of the turbine region 12. This results in compressive forces that are to be passed into the casing element 24. There are several possibilities for passing these compressive forces into the casing element 24. Thus, for example, the front support element 50 can be provided with an axial stop, which is supported on the hub element 26 and/or the strut 42. The compressive forces are hereby then passed via the strut 42 by means of a relatively long lever arm into the casing element 24, however.

In order to avoid the relatively long lever arm, it is possible, for example, for the fairing element 46 to be supported directly on the casing element 24 in the axial direction. A drawback of this is, for example, that, as a result, heat can be locally diverted into the casing element 24. Moreover, this can result in a tedious assembly. Another possibility for accommodating the compressive force is, for example, to pass the compressive forces via the outer shroud 82 of the guide vane 56 toward a casing that is connected to the casing element 24 and follows it in the direction of flow, such as, for example, the casing element 76. However, this could result in a tedious assembly.

Another possibility of passing the compressive forces into the casing element 24 in an especially simple way is revealed by regarding FIG. 2 as well. The fairing element 46 has first form-fitting elements in the form of an integral tab 84. The strut 42 has corresponding second form-fitting elements in the form of forks 86, through which uptake spaces 88 are delimited. In this case, the tabs 84 are accommodated at least partially in the uptake spaces 88 and are covered by the forks 86 in the axial direction toward the respective turbine regions 12, 14. The forks 86 are also an integral component of the struts 42. This means that the forks 86 are constructed together with the strut 42 in one piece. Furthermore, the tabs 84 are constructed together with the fairing element 46 in one piece.

The advantage of this support consists in the fact that the compressive forces can be passed into the casing element 24 by means of a very small lever arm, that is, via an only very small or short path and thus almost directly. In order to keep the path especially small, the form-fitting elements are arranged on a side 90 of the fairing element 46 that faces away from the hub element 26 in the radial direction.

Overall, it can be seen that it is possible to realize a low weight, low costs, little leakage of sealing air, and an especially long service life of critical components of the mid-frame 10. The low weight and the low costs can be realized in that, for example, the fairing element 46 and the guide vane 56 are supported on the hub element 26 in the radial direction inward in an especially simple way and thus can be retained. Furthermore, the chamber 68 can be sealed especially well with simple means, so that leakage of sealing air can at least be kept small. Moreover, thermally induced movements of the guide vane elements and/or the fairing elements can be kept small relative to one another, so that the wear of the mid-frame 10 can also be kept within a narrow scope. Furthermore, neither the fairing element 46 nor the guide vane 56 is directly fastened to the casing element 24, so that the heating of the outer casing element 24, that is, the input of heat into the outer casing element 24, can be kept especially small.

FIG. 3 shows the gas turbine according to a second embodiment. In the second embodiment, at least one catch 92 is provided, by means of which the guide vane 56 is supported on the casing element 24 in the peripheral direction, so that circumferential forces, which result from the diversion of the gas effected by the guide vane 56, can be directed from the guide vane 56 into the casing element 24. It is possible by means of this catch 92 to dispense with the relatively long lever arm mentioned above. FIG. 4 shows a third embodiment of the gas turbine, in which the catch 92 is also provided.

In the second embodiment, the fairing element 46 has circumferential connecting pieces 94, by means of which a circumferential groove 96 of the fairing element 46 is delimited or formed in the axial direction. Axial forces can be transmitted onto a separate structural component 98, which is fastened to the outer casing element 24, by means of the connecting pieces 94 or the groove 96. The fairing element 46 can move relative to the structural component 98 in the radial direction. The fixing of the fairing element 46 in place in the peripheral direction occurs via the above-mentioned, at least one catch 92.

Another possibility for axial support is shown on the basis of FIG. 4. In FIG. 4 or in the third embodiment, the axial support of the fairing element 46 occurs via at least one connecting piece 100, which is an integral component of the guide vane 56 and is supported on a surface of the casing element 76 arranged downstream. In this case, the contact point serves as a seal between the connecting piece 100 and the casing element 76.

The invention claimed is:

1. A mid-frame for a gas turbine, having at least one outer casing element, having at least one hub element arranged on the inside of the outer casing element in the radial direction, having at least one strut connecting the outer casing element to the hub element, and having at least one fairing element that delimits at least partially a duct at least in the radial direction, through which a gas can flow, said fairing element having a passage opening, through which the strut passes, the passage opening cladding the strut on an outer peripheral side of the strut that passes through the fairing element, wherein the fairing element is coupled in the radial direction to at least one support member of the hub element and at least one guide vane, the at least one guide vane for at least partial guiding of the gas flowing through the duct.

2. The mid-frame according to claim 1, wherein the support element is constructed separately from the hub element and separately from the fairing element.

3. The mid-frame according to claim 1, wherein the guide vane is fastened to the fairing element.

4. The mid-frame according to claim 3, wherein the guide vane is fastened to the fairing element in the axial direction.

5. The mid-frame according to claim 1, wherein the fairing element and the strut each have form-fitting elements extending, respectively, therefrom, the form-fitting elements supporting the fairing element on the strut in the axial direction.

6. The mid-frame according to claim 5, wherein the form-fitting elements are arranged in the radial direction closer to the outer casing element than to the hub element.

7. The mid-frame according to claim 1, wherein the guide vane has an outer shroud in the radial direction, wherein a chamber that at least partially surrounds the duct is delimited at least partially by the outer shroud and the fairing element.

8. The mid-frame according to claim 7, further comprising at least one sealing element supported on at least one support flange of the outer shroud, the at least one sealing element forming a seal between the chamber and the duct.

9. The mid-frame of claim 1, wherein at least one mid-frame is employed in a gas turbine, wherein the duct is arranged between two turbine regions in the direction of flow of the gas.

10. A mid-frame for a gas turbine, having at least one outer casing element, having at least one hub element arranged on the inside of the outer casing element in the radial direction, having at least one strut connecting the outer casing element to the hub element, and having at least one fairing element that delimits at least partially a duct at least in the radial direction, through which a gas can flow, said fairing element having a passage opening, through which the strut passes, for at least partial cladding of the strut on the outer peripheral side, wherein the fairing element is coupled in the radial direction at the hub element, wherein the fairing element and the strut each have form-fitting elements extending, respectively, therefrom, the form-fitting elements supporting the fairing element on the strut in the axial direction.

11. The mid-frame according to claim 10, wherein the form-fitting elements are arranged in the radial direction closer to the outer casing element than to the hub element.

* * * * *